United States Patent [19]

Hashimoto et al.

[11] Patent Number: 4,687,125

[45] Date of Patent: Aug. 18, 1987

[54] APPARATUS FOR CHANGING THE TRAVELING DIRECTION OF A WEB-LIKE MATERIAL

[75] Inventors: Kazuyoshi Hashimoto; Tsuneo Nakano; Kazutoyo Arita; Goro Fukuyama; Yoshio Shimosato, all of Hiroshima, Japan

[73] Assignee: Mitsubishi Jukogyo Kabushiki Kaisha, Tokyo, Japan

[21] Appl. No.: 819,973

[22] Filed: Jan. 15, 1986

Related U.S. Application Data

[63] Continuation of Ser. No. 622,263, Jun. 19, 1984.

[51] Int. Cl.[4] ..... B65H 23/038; B65H 23/32; B65H 27/00

[52] U.S. Cl. ..... 226/21; 226/189; 226/197

[58] Field of Search ..... 226/18, 21, 22, 23, 226/180, 189, 196, 197; 242/76

[56] References Cited

U.S. PATENT DOCUMENTS

| | | | |
|---|---|---|---|
| 302,311 | 7/1884 | Anthony | 226/197 |
| 1,273,926 | 7/1918 | Roesen | 226/197 X |
| 3,223,303 | 12/1965 | Hunter | 226/197 |
| 3,406,887 | 10/1968 | Laycak | 226/21 |
| 3,583,621 | 6/1971 | Bryant | 226/197 X |
| 4,155,496 | 5/1979 | Houck | 226/197 X |
| 4,342,412 | 8/1982 | Lorenz et al. | 226/21 |
| 4,343,422 | 8/1982 | Dabringhaus et al. | 226/197 |

FOREIGN PATENT DOCUMENTS

| | | | |
|---|---|---|---|
| 2320295 | 11/1974 | Fed. Rep. of Germany | 226/21 |
| 54-8462 | 4/1979 | Japan . | |
| 55-80641 | 6/1980 | Japan . | |
| 56-3508 | 1/1981 | Japan . | |

OTHER PUBLICATIONS

Moore, J. A. and R. K. Turley, *Guiding for Endless Mobius Printer Ribbon,* IBM Technical Disclosure Bulletin, vol. 11, No. 2, 7/1968 p. 130.

*Primary Examiner*—Harvey C. Hornsby
*Assistant Examiner*—Scott J. Haugland
*Attorney, Agent, or Firm*—Wenderoth, Lind & Ponack

[57] ABSTRACT

An apparatus for changing the direction of travel of a web-like material without inverting the front and rear surfaces of the web-like material is improved in that a plurality of guide rotors are disposed on each of a plurality of spiral curves along an imaginary conical surface so as to be rotatable about axes intersecting at right angles with the corresponding spiral curve on the imaginary conical surface, and a conical surface formed by an enveloping surface of these guide rotors is used as a traveling path of the web-like material, whereby shortcomings inherent in such apparatus in the prior art can be eliminated.

1 Claim, 7 Drawing Figures

APPARATUS FOR CHANGING THE TRAVELING DIRECTION OF A WEB-LIKE MATERIAL

This application is a continuation of now abandoned application Ser. No. 622,263, filed June 19, 1984.

The present invention relates to an apparatus for changing the direction of travel or the traveling direction, of a web-like material that is being moved along a travel path.

In the case of manufacturing sheet steel, it must be subjected to a number of treatment processes. On the other hand, in recent years, as one factor of rationalization for manufacture of sheet steel, continuation of a plurality of treatment processes, that is, continuation of movement of the steel from one piece of equipment to another piece of equipment has been investigated in various manners. However, since it involves various problems of the installation area and other aspects to array a number of pieces of equipment in a linear manner, in order to enable arrangement of pieces of equipment in a small area, it is contemplated to change the traveling direction of a steel sheet. This is also necessary for achieving continuation of movement between existing pieces of equipment.

Figure 1:
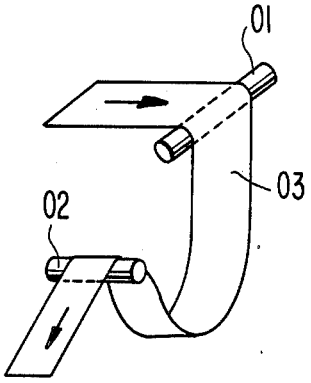
FIG. 1. (PRIOR ART)
Figure 2:
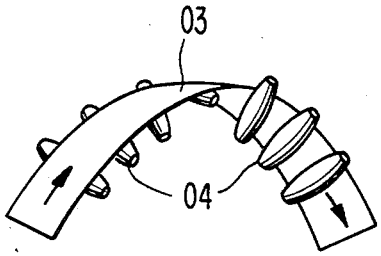
FIG. 2. (PRIOR ART)

Heretofore, as means for changing the traveling direction of a steel sheet, a free loop system, a twist roll system, etc. have been proposed. The free loop system is a system in which two rolls 01 and 02 are disposed in different directions and the traveling direction of a steel sheet 03 is changed by sagging and twisting the steel sheet 03 between these rolls 01 and 02 as shown in FIG. 1, and the twist roll system is a system in which a large number of rolls 04 are arrayed in twisted positional relationship to each other and the traveling direction of a steel sheet 03 is changed by leading the steel sheet 03 along these rolls 04 as shown in FIG. 2. However, in the first-mentioned free loop system, the traveling velocity of the steel sheet is limited due to rocking motion of the free loop portion, that is, the sagging portion of the steel sheet, and consequently the applicable field of this system is restricted. Also, in the twist roll system, since a large convex crown is formed on the roll 04 because of technical requirements, when the traveling direction of the steel sheet 03 is changed the circumferential velocity of the roll 04 is different in the widthwise direction of the steel sheet, so that slip may occur between the roll 04 and the steel sheet 03, and therefore, there is a problem that this system is applicable only to a steel sheet 03 having a narrow width.

Figure 3:
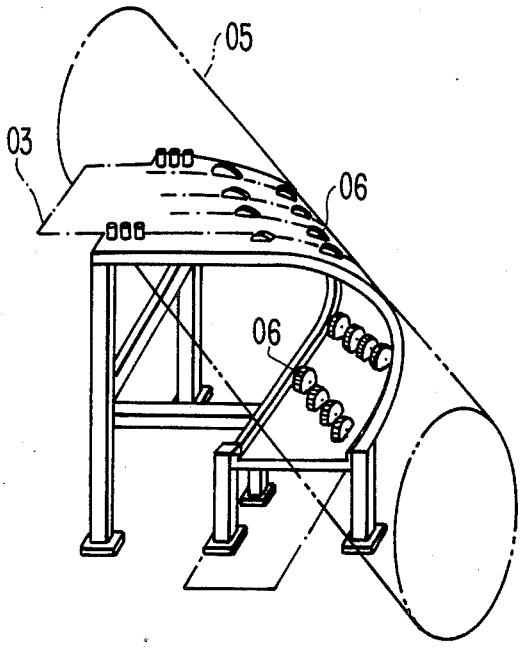
FIG. 3. (PRIOR ART)

Recently, however, as means for resolving the above-described problems associated with the means for changing the traveling direction of a steel sheet in the prior art, an apparatus for changing the traveling direction of a steel sheet as shown in FIG. 3 has been proposed. In this apparatus, a plurality of guide rollers 06 are disposed on each of a plurality of spiral curves on an imaginary cylindrical surface 05, and the traveling direction of a steel sheet 03 is changed by moving the steel sheet 03 in a spiral manner along these guide rollers 06. This apparatus has an inherent property of such mechanisms that the top surface of a steel sheet on the inlet side which is directed upwardly will be on the underside on the outlet side of the apparatus. In general, scratches on the respective surfaces of the steel sheet 03 will be produced more on its rear surface than on its front surface due to interaction with guide members or the like. Accordingly, the inversion of the front and rear surfaces of the steel sheet 03 as described above in the course of the manufacturing process of the steel sheet 03, may result in degradation of its quality, and therefore, this is not favorable.

The present invention has been worked out in view of the above-described background of the invention, and it is a principal object of the present invention to provide an apparatus for changing the traveling direction of a web-like material without inverting the front and rear surfaces of the web-like material.

According to one feature of the present invention there is provided an apparatus for changing the traveling direction of a web-like material, in which a plurality of guide rotors are disposed on each of a plurality of spiral curves along an imaginary conical surface so as to be rotatable about axes intersecting at right angles with the corresponding spiral curve on the spiral conical surface and a conical surface formed by an enveloping surface of these guide rotors is used as the travel path of the web-like material.

Figure 4:
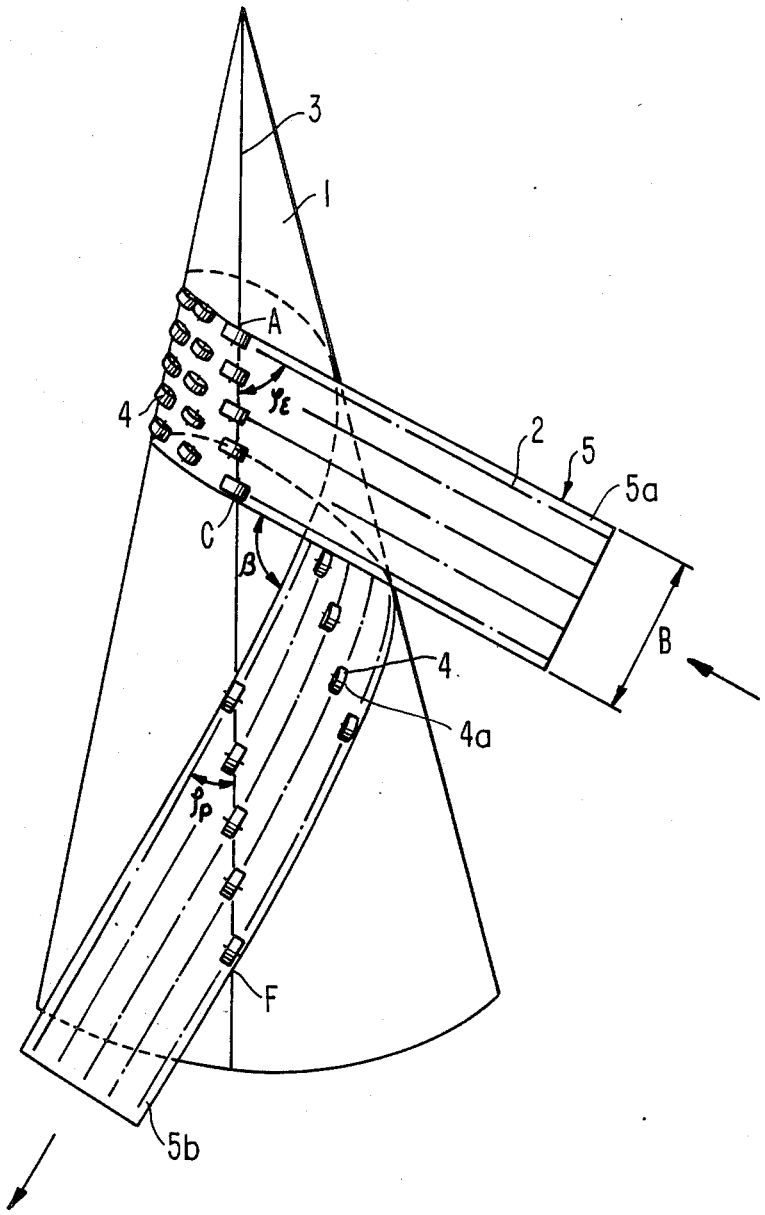
Figure 5:
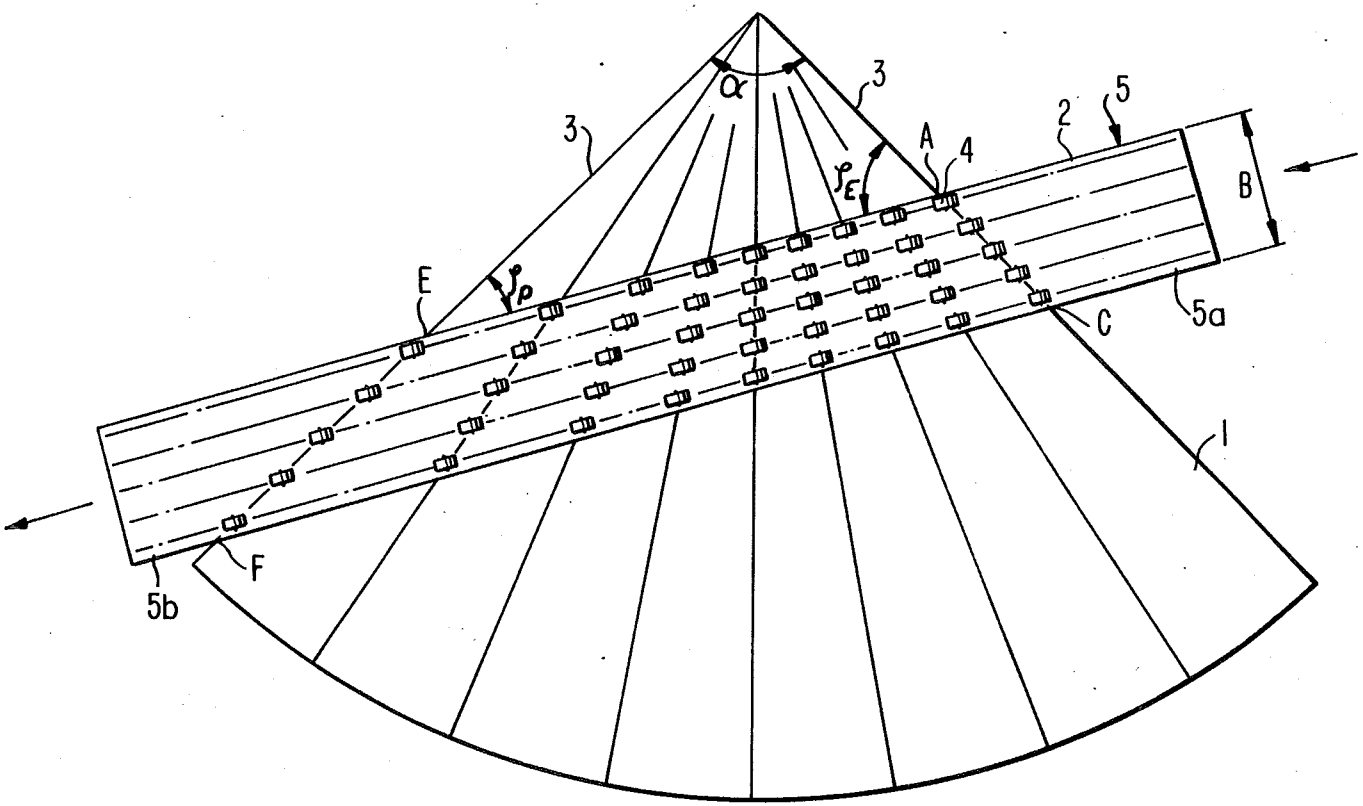
Figure 6:
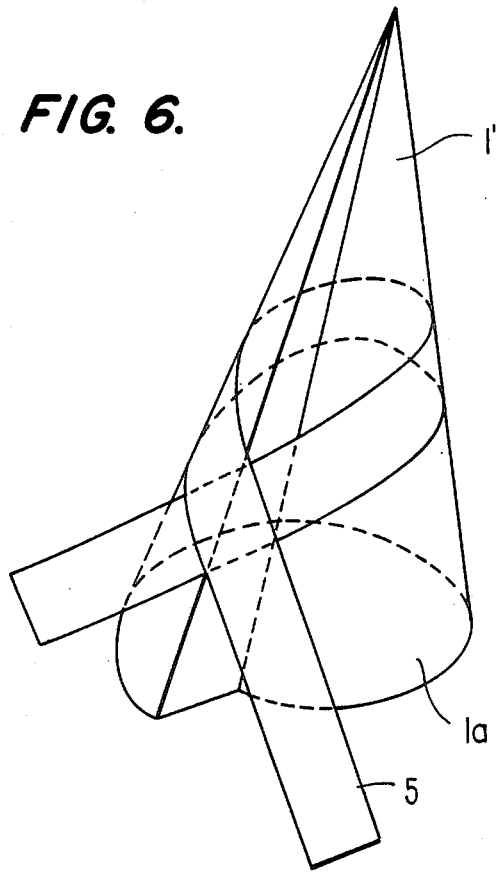
Figure 7:
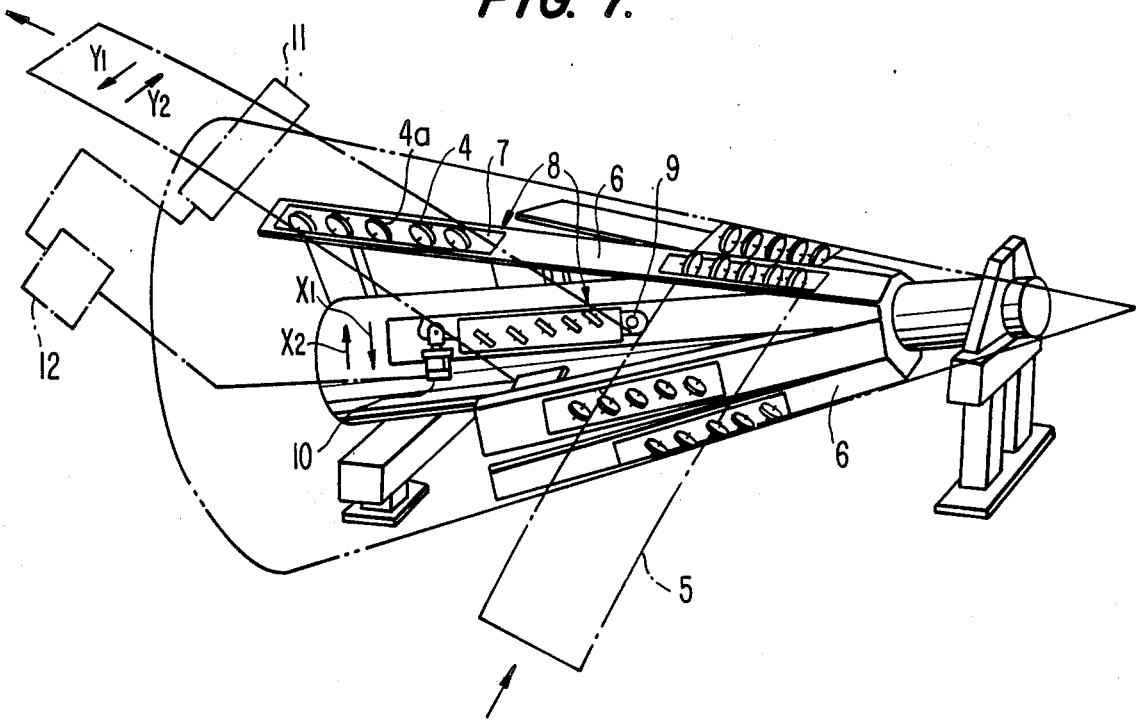

The above-described and other features and objects of the present invention will become more apparent by reference to the following description of preferred embodiments of the invention taken in conjunction with the accompanying drawings, wherein:

FIGS. 1 to 3, respectively, are schematic views showing different prior art apparatuses for changing the traveling direction of a web-like material, FIG. 4 is a conceptional view showing one preferred embodiment of an apparatus for changing the traveling direction of a web-like material according to the present invention, FIG. 5 is a developed view of an array of guide rollers and an imaginary conical surface in the apparatus shown in FIG. 4, FIG. 6 is a conceptional view showing another preferred embodiment of the present invention, and FIG. 7 is a schematic perspective view showing a practical structure of the apparatus according to the first preferred embodiment of the present invention.

Now the apparatus for changing the traveling direction of a web-like steel sheet according to the present invention will be described in greater detail with reference to the accompanying drawings.

Referring at first to FIG. 4 which shows a basic inventive concept of the present invention, reference numeral 1 designates an imaginary conical surface which has the shape of a circular cone, and numeral 2 designates a plurality of imaginary spiral curves arranged along the imaginary conical surface 1, each of the imaginary spiral curves makes a spiral angle of $\phi_E$ with respect to a generatrix 3 of the imaginary conical surface 1 at a point where the imaginary spiral curve begins to wind around the imaginary conical surface 1. Guide rollers 4 serving as the guide rotors are arrayed along each spiral curve 2 along the imaginary conical surface 1 with their rotational axes 4*a* intersecting at right angles with the corresponding spiral curve 2. A web-like steel sheet 5 is moved along a travel path consisting of a conically curved surface that is formed of the enveloping surface of the guide rollers 4. Since the direction of the circumferential velocity of the guide roller 4 at the point where the roller makes contact with the steel sheet 5 always coincides with the tangential direction of the spiral curve 2, the steel plate 5 can have its traveling direction changed smoothly along the spiral curve 2. In FIGS. 4 and 5, reference character B represents the width of the web-like steel sheet 5.

FIG. 5 shows the array of the guide rollers 4 relative to the imaginary conical surface 1 and the web-like steel sheet 5 in a developed condition. The group of guide rollers 4 is arrayed within a strip-shaped trapezoid ACFE having a width B and making an angle $\phi_E$ with respect to a generatrix 3 on which the imaginary conical surface 1 begins to make contact with the steel sheet 5, and the rotational axes of these rollers 4 are directed at right angles to the traveling direction of the steel sheet 5. Again with reference to FIG. 4, considering now the case where the traveling direction of the steel sheet 5 on the side of the inlet to the imaginary conical surface 1 makes an angle of 90° with respect to that on the side of the outlet from the imaginary conical surface 1 (the case of $\beta=90°$), the sum of the angles $\phi_E$ and $\phi_D$ formed between the generatrix 3 and the steel sheet portions on the inlet side 5*a* to and the outlet side 5*b* from the imaginary conical surface 1, respectively, would become 90°, and hence, it will be seen from FIG. 5 that the vertical angle $\alpha$ in the developed view of the imaginary conical surface 1 would be also 90°. From similar consideration, it can be proved that in the case where the outlet side portion 5*b* of the steel sheet 5 is placed on the same plane as the inlet side portion 5*a* of the steel sheet 5 and it is desired to change the traveling direction of the steel sheet by an angle $\beta$ between the respective portions, it is only necessary to chose the vertical angle $\alpha$ in the developed view of the imaginary conical surface so as to fulfil the relation of $\alpha=\beta$ and to wind the steel sheet 5 around the imaginary conical surface one complete revolution.

As a matter of course, even in the case of $\alpha\neq\beta$, the traveling direction of the steel sheet 5 on the outlet side can be arbitrarily set by selecting the angle formed between the respective traveling directions of the inlet and outlet side portions of the steel sheet 5 with respect to the imaginary conical surface 1 to be virtually equal to $\beta$ by adjusting the amount of winding around the imaginary conical surface 1 of the steel sheet 5, that is, by winding the steel sheet 5 around the imaginary conical surface 1 by more than one revolution or by less than one revolution instead of by just one complete revolution. However, in this case, since the inlet side portion 5*a* and the outlet side portion 5*b* of the steel sheet 5 are not placed on the same plane, after changing the traveling direction of the steel plate 5, it is necessary to again correct the traveling direction of the steel sheet 5 in the horizontal, vertical or other direction depending on whether this is necessary or not.

In addition, in the case where it is unnecessary to make the traveling directions of the inlet side portion and the outlet side portion of the steel sheet 5 with respect to the imaginary conical surface 1 on the same plane, the same effect can be achieved even if the imaginary conical surface is formed on a sprial conical surface 1′ whose bottom cross-section 1*a* is in the shape of a spiral curve as shown in FIG. 6 and the steel sheet 5 is wound around this modified imaginary conical surface.

It is to be noted that since the array of the guide rollers 4 forms a staggered array as viewed in the traveling direction of the steel sheet 5, as a coadjutant effect of such guide roller array and the above-described fact that the direction of the circumferential velocity of the guide roller coincides with the tangential direction of the spiral curve 2 which corresponds to the traveling direction of the steel sheet 5, the individual guide rollers 4 can smoothly change the traveling direction of the steel sheet 5.

In FIG. 7 is shown one example of a practical structure of the apparatus for changing a traveling direction of a web-like material according to the present invention. A plurality of cone frames 6 are disposed along generatricies 3 of an imaginary conical surface 1 by means of bearing not shown. Guide rollers 4 are supported on the cone frames 6 in such manner that their rotational axes 4*a* may intersect at right angles with a plurality of spiral curves 2 along the imaginary conical surface 1, and in the illustrated example, a group of guide rollers 4 to be aligned on a same generatrix 3 are assembled on a base 7 to form a guide roller assembly 8 and this assembly is mounted on the cone frame 6.

A surface enveloping the above-described guide rollers 4 is a spiral surface, and since a steel sheet 5 is passed along this spiral surface, the traveling direction of the steel sheet 5 can be changed smoothly without inverting its front and rear surfaces. It is to be noted that in this apparatus, maintenance and inspection of the apparatus is easy because a group of guide rollers 4 are assembled into an assembly.

It is possible to provide means for preventing zig-zag traveling of a steel sheet in this apparatus for changing the traveling direction. In FIG. 7, one end of at least one guide roller assembly 8 is pivotably mounted on the cone frame 6 on a fulcrum pin 9, a cylinder 10 is coupled to the other end of the assembly, and on the other hand a zig-zag traveling detector (for instance, a photocell or the like) 11 for detecting the degree of zig-zag traveling of a steel sheet 5 is provided on the outlet side of the steel sheet 5, and provision is for the above-described cylinder 10 to be controlled by a controller 12 in response to a detection signal issued from the zig-zag traveling detector 11.

In the event that the steel sheet 5 has been passed without inducing zig-zag traveling, the traveling direction of the steel sheet 5 is changed by the action of the guide rollers 4 in themselves. If zig-zag traveling of the steel sheet 5 is induced, then the above-described mechanisms operate so as to correct the zig-zag traveling. In the case where the direction of the steel sheet 5 after its traveling direction has been changed is to be corrected in the direction indicated by arrow $Y_1$, the cylinder 10 is actuated by the controller 12 depending upon the detected degree of zig-zag traveling supplied from the zig-zag traveling detector 11, and so, the guide roller assembly 8 is correctively moved in the direction indicated by arrow $X_1$ i.e. substantially parallel to a tangent to the cone adjacent the free end of the guide roller assembly. As a result of this corrective movement of the guide roller assembly 8, the direction of the steel sheet 5 after its traveling direction has been changed, can be corrected. In the case where the zig-zag traveling of the steel sheet 5 is directed in the opposite direction to the above-described case, the guide roller assembly 8 is moved in the opposite direction.

While correction of zig-zag traveling of a steel sheet 5 is effected by correctivley moving an assembly of a part of the guide rollers 4 in the illustrated example, it is also possible to effect correction of zig-zag traveling by moving all the guide roller assemblies 8. In that case, instead of correctively moving all the guide roller assemblies 8, even if the entire imaginary cone frame 6 is rotated about the center axis of the imaginary circular cone by means of a driving device such as a cylinder, an electric motor, etc. in response to a signal issued from the controller 12 depending upon the detected degree of zig-zag traveling, the same effects and advantages can be obtained.

It is to be noted that the present invention is not limited to a web-like steel sheet 5, but it is equally applicable to any web-like material which does not undergo affects on quality as a result of contact with the guide rollers 4. In addition, while the description has been given of employing a regular circular cone as one example of the imaginary conical surface in the above-described practical example, it is a of course possible that the present invention can be embodied by employing a generally circular cone rather than a regular circular cone or a pyramid. Moreover, while guide rollers 4 the rotational axes 4*a* of which intersect at right angles with spiral curves 2 were employed as guide rotors in the above-described practical example, it is also possible to employ spherical bodies or the like the surfaces of which make contact with a web-like material at points or lines.

As described in detail above in connection with preferred embodiments of the invention, in the apparatus for changing the traveling direction of a web-like material according to the present invention, the traveling direction of a web-like material is changed by means of rotors arrayed on spiral curves along the conical surface, and hence the traveling direction of the web-like material can be changed without inverting the front and rear surfaces of the web-like material. Furthermore, regardless of whether a width of a web-like material is large or small, the change of the traveling direction can be achieved smoothly.

Since many changes and modifications can be made in the above-described construction without departing from the spirit of the present invention, it is intended that all matter contained in the above description and illustrated in the accompanying drawings shall be interpreted to be illustrative and not in a limiting sense.

What is claimed is:

1. As apparatus for changing the traveling direction of a web-like material, comprising a plurality of lines of small individual guide rollers, the guide rollers in each line being spaced along one of a plurality of parallel spiral curves extending along an imaginary conical surface, corresponding rollers in the parellel lines being in sets with each set having rollers lying at spaced intervals along one of a plurality of generatricies of the imaginary conical surface, support members lying along said generatricies and each having one respective set of rollers rotatably mounted thereon about axes intersecting the respective spiral curves at right angles to the curves, an imaginary spiro-conical surface formed by an imaginary surface enveloping said guide rollers and tangent to the outer peripheries of said guide rollers being a traveling path for the web-like material with said rollers rotating in the direction of said traveling path at the points of support for the web-like material, at least one of said support members having a first and second end being pivotally mounted at the first end which is remote from the base of said imaginary conical surface for movement of the second end thereof which is toward the base of said imaginary conical surface substantially parallel to a tangent to the conical surface adjacent said second end of the support member, means for sensing the lateral position of the web-like material as it leaves said apparatus, and means connected between said sensing means and said pivotally mounted support member for pivoting said support member to bring the lateral position of the web-like material moving along said traveling path to a predetermined lateral position if the sensed lateral position is different from the predetermined lateral position.

* * * * *